United States Patent [19]

Claywell

[11] 4,195,373

[45] Apr. 1, 1980

[54] DOUBLE FLUSH VALVE ASSEMBLY

[76] Inventor: James R. Claywell, 919 - 38th St. West, Bradenton, Fla. 33505

[21] Appl. No.: 932,555

[22] Filed: Aug. 10, 1978

[51] Int. Cl.[2] ..... E03D 1/14; E03D 1/34

[52] U.S. Cl. ..... 4/326

[58] Field of Search ..... 4/329, 326

[56] References Cited

U.S. PATENT DOCUMENTS

| | | | |
|---|---|---|---|
| 3,918,105 | 11/1975 | Young | 4/326 |
| 4,096,591 | 6/1978 | Awls | 4/326 |
| 4,122,564 | 10/1978 | Addicks et al. | 4/326 |

*Primary Examiner*—Houston S. Bell, Jr.
*Attorney, Agent, or Firm*—John Orman

[57] ABSTRACT

A double flush valve assembly of the type designed to be fitted to existing, prior art flush tanks which is found in residential or commercial toilet facilities wherein a first and second flush valve elements are located at different depths within the interior of the tank and each operated separately by independent spaced apart handle elements such that the first valve element is activated to produce a normal flush using the conventional amount of water when heavy waste material is required to be disposed. Similarly, the second valve element is activated through activation of a separate handle when lighter waste material is needed to be disposed such as when a child utilizes the toilet facilities. A plurality of vents are interconnected to the housing means of the valve assembly to provide a "fast flush" thereby utilizing less water through the elimination or decrease of negative pressure within the housing and outlet of the flush tank.

10 Claims, 6 Drawing Figures

FIG. 1
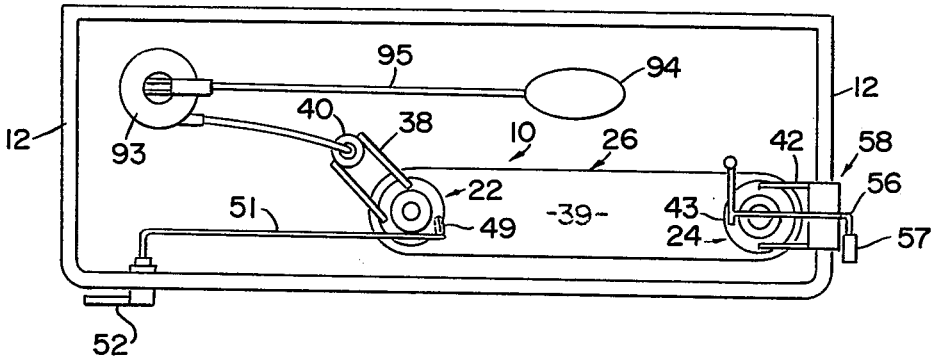
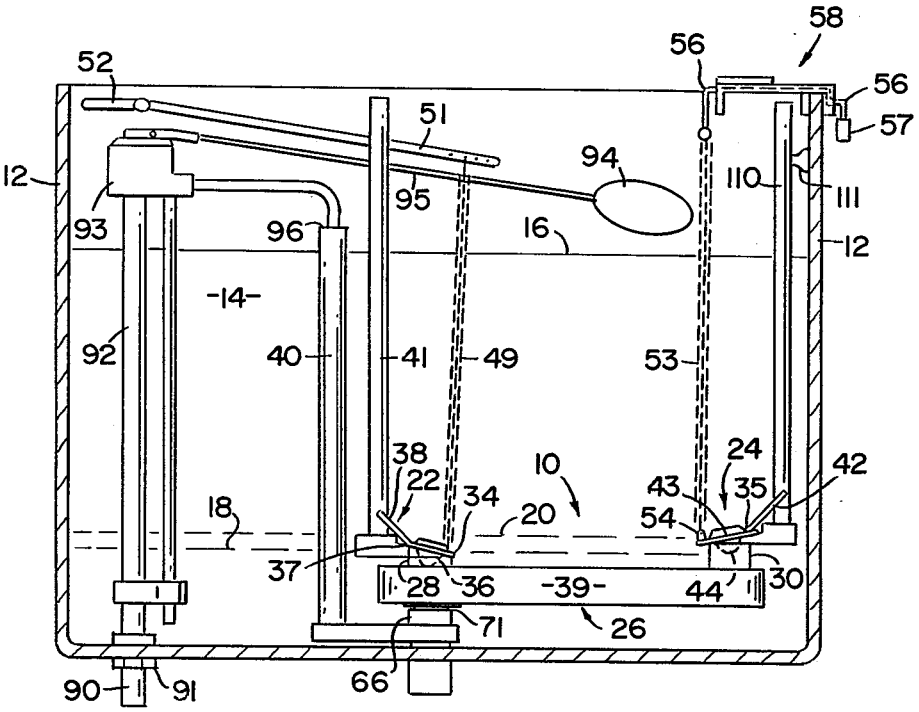
FIG. 2

FIG. 3
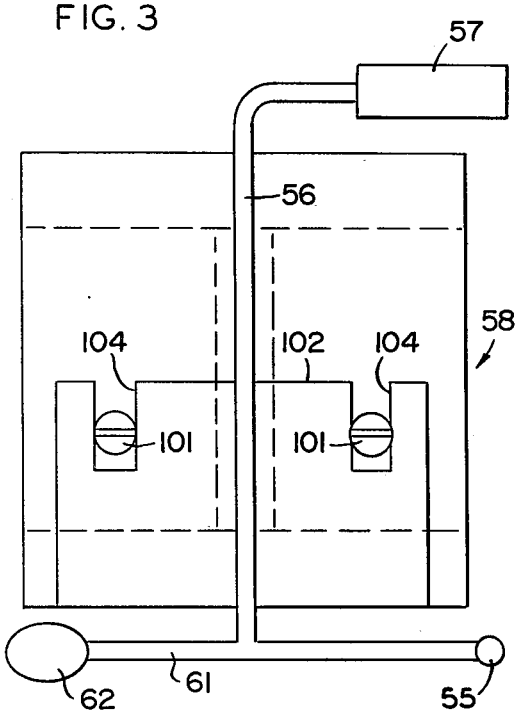
FIG. 5
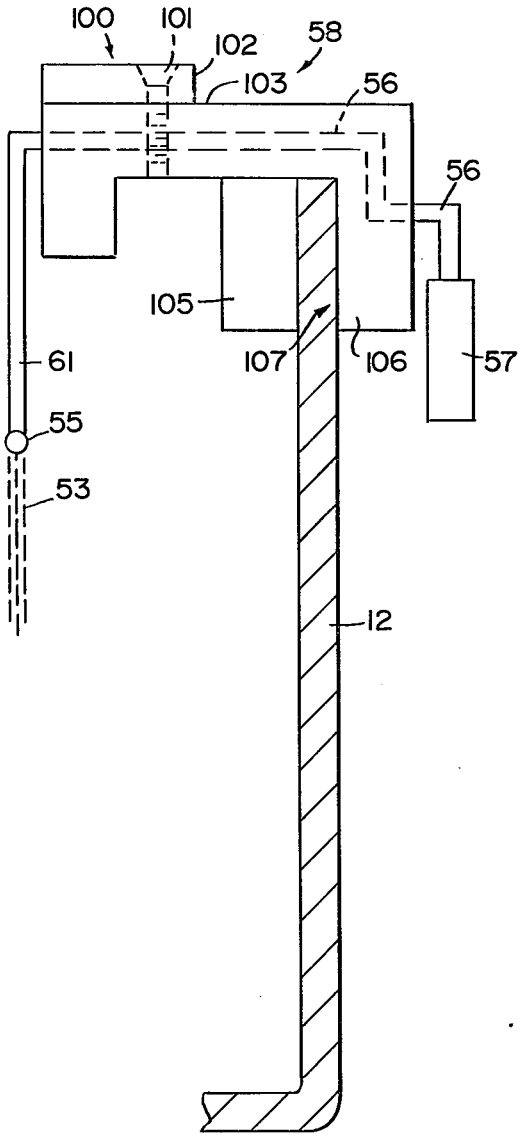
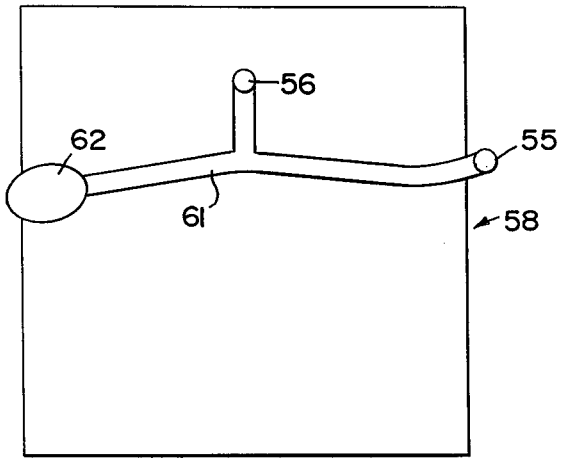
FIG. 4
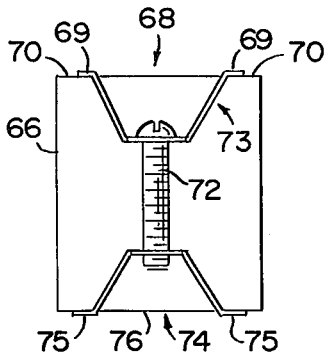
FIG. 6

DOUBLE FLUSH VALVE ASSEMBLY

BACKGROUND OF THE INVENTION

1. Field of the Invention

This invention relates to a double flush valve assembly of the type used in conventional toilet facilities, either residential or industrial for the purpose of releasing two different quantities of water from the flush tank dependent upon the quantity or type of waste material which is being flushed or removed from the toilet bowl.

2. Description of the Prior Art

In the activation or removal of waste from conventional toilet facilities the user is provided with access to a single flush handle which operates a flush valve on the interior of the flush tank. This valve is seated on or about a conduit leading to the outlet to the flush tank which in turn directs water from the flush tank to the toilet bowl for cleaning and removal of waste from the bowl itself. Generally, the single flush valve and valve seat are located at or about the bottom of the flush tank such that when opened the entire water within the tank is emptied into the flush bowl and removed. While this has proved, for extended periods of usage by modern society, to be an efficient and operable manner of waste disposal it has readily been determined that the amount of water used to dispose of the waste material is generally in excess of over that which is absolutely needed for such waste disposal.

In modern society and especially with increased population throughout the world many natural resources, which once were though to be limitless, have now come into rather short supply. Specifically, water has not become a major concern of conservation throughout the world. Vast amounts of water being wasted through the utilization of prior art devices which were designed when it was thought that the supply of water throughout various parts of the country and the world were limitless or plentiful.

Accordingly, it can be seen that there is a great need in society generally for a water saving device which can be readily adapted to existing toilet facilities so as to eliminate the usage of such great quantities of water when in fact such large quantities of water are not needed for effective waste disposal.

In order to overcome this problem numerous types of devices have been designed which generally attempt to utilize less water in toilet facilities for a conventional flushing operation. Of such prior art attempts which provide a double flush valve or a plurality of flush valves within the same tank have been frequently attempted. In such prior art structures, typically a first valve assembly is located in substantially the conventional position, near the bottom or lower depths of the flush tank. A second valve assembly is located at a higher level or shallower depth within the tank. Normally both valve assemblies are operated off a single handle wherein manipulation of the handle in different directions or a different manner serves to operate one of the two valve assemblies thereby releasing different quantities of water from the flush tank dependent upon the quantity or state of the waste which is intended to be disposed.

Such prior art double flush valve assemblies, while operable are generally considered to be overally-complicated and not readily adaptable to existing flush tank or toilet bowl facilities. Thereby the utilization of numerous of such prior art double flush valve assemblies requires the complete reconstruction or design of flush tank facilities and the removal, destruction or extensive modification of existing facilities.

Accordingly, there is a great need in modern day society for a device which will save excessive amounts of water from unnecessary use and waste through the incorporation of a dual or double flush valve assembly which is readily adaptable to existing flush tank and toilet bowl facilities. Ideally, such an assembly could be readily fitted or adapted to the conventional or existing facilities by a person of average mechanical ability and would not require the calling or services of a plumber or one having a high degree of skill in the plumbing industry.

SUMMARY OF THE INVENTION

This invention relates to a double flush valve assembly of the type designed to be used in conventional flush tanks associated with and in fluid communication with toilet bowls designed for usage in residential or commercial facilities. More importantly the subject invention is directed to a double flush valve which is relatively compact and capable of being installed essentially as a single assembly in existing and conventional flush tanks with a minimum amount of structural adaptation to the flush tank such that any person of ordinary mechanical ability can readily adapt the subject flush valve assembly to conventional or existing toilet bowl facilities without the aid of a plumber or other person skilled in the plumbing industry.

More specifically the flush valve assembly of the present invention comprises a housing including conduit means having a first valve means attached thereto. The first valve means and accompanying first conduit means is located at a greater depth within the interior of the flush tank than a second valve means. This second valve means is defined in part at the inlet to a second conduit means which is also part of the housing. The second conduit means is disposed upwardly or at a lesser depth within the fluid tank from the first conduit means. The second conduit means is provided with a second conduit inlet on which the second valve element of the second valve means is seated. Accordingly, the higher disposition of the second valve means, in combination with the second conduit inlet provides the release of much less water when the second valve means is disposed in its open position. Accordingly, approximately a gallon and a half of water is saved with each activation of the flush valve assembly when the second valve means is activated rather than the first. The activation of the second valve means is proper and adequate when lighter waste material has been deposited within the toilet bowl and requires removal. Such frequently occurs when a child utilizes the toilet facilities or when only urine is required to be removed from the toilet bowl. It can be readily seen therefore that repeated use of only the second valve means for removing waste from the toilet bowl will save great quantities of water even when considering the amount of usage of the average American family.

A mounting means in the form of a substantially elongated sleeve is disposed in interconnected relation to the flush tank and the housing itself. The sleeve is configured for disposition directly within the flush tank outlet itself. The sleeve protrudes to a certain depth within the flush tank outlet. A connecting bracket is also included within the mounting means and is utilized so as to interconnect the housing to the sleeve itself. The first and second conduit means are both interconnected in fluid communication to one another through an interconnecting conduit. The first conduit is connected to the sleeve disposed within the flush tank outlet upstream of the interconnecting conduit. Accordingly, irrespective of which of the first or second valve means are opened or activated water will flow from the interior of the flush tank through the sleeve and out through the flush tank outlet into the toilet bowl in the conventional fashion. Adaptation or attachment of the entire double flush valve assembly to the flush tank interior merely requires the positioning of the sleeve within the flush tank outlet and the attachment of the connecting bracket at its opposite ends between the sleeve and the housing itself.

Other structural features of the double flush valve assembly includes the provision of vent means. A first vent in the form of a conventional snorkel conduit or pipe is disposed in interconnected relation between the housing and/or the sleeve beneath the first valve means. The longitudinal dimension of the snorkel or vent conduit extends upwardly to an air space generally above the normal level of water within the flush tank. Accordingly, this vent conduit acts as a drain pipe to prevent overflow of the water in the flush tank.

The vent means further includes a second vent conduit connected adjacent to the first valve means. More specifically, a second vent conduit is attached adjacent to the valve element of the first valve means and extends through the first conduit means thereof so as to provide venting air directly into the first conduit. This extra or supplementary air supply relieves any negative pressure which would generally be created during normal flow of the water through the second conduit means or other portions of the housing during a flushing operation. Therefore, a "fash flush" is provided which may be defined as the ability of the water to empty from the interior of the flush tank, through the conduit means of the housing and pass through the flush tank outlet at a faster flow rate due to the provision of excess air passing into the conduit means and the elimination or reduction of any negative pressure which would tend to slow the flow rate down of the water as it flows through the conduit means of the interior of the flush tank.

For practical purposes and an important structural feature of the double flush valve assembly is the provision of separate handles disposed in spaced apart relation and connected to the interior or accessible portions of the flush tank at different locations. This is particularly useful when small children are operating the toilet facilities. Confusion is thereby eliminated if the child is "assigned" use of his "own" flush handle. This separation and distinct segregated relation of the various handles also serves to eliminate confusion for adults and to overcome problems when a single handle is intended for the activation of two separate flush valves by manipulation in a different direction as commonly known to the prior art.

BRIEF DESCRIPTION OF THE DRAWINGS

For a fuller understanding of the nature and objects of the invention, reference should be had to the following detailed description taken in connection with the accompanying drawings in which:

FIG. 1 is a top plane view of the flush tank and the interior wherein the components of the double flush valve assembly are shown in relative position to one another.

FIG. 2 is a sectional view showing the interior of the flush tank and the interior of the housing and conduit means comprising certain components of the double flush valve assembly.

FIG. 3 is a top view of the handle assembly controlling the second valve means.

FIG. 4 is a front view of a portion of the structural embodiment of FIG. 3.

FIG. 5 is a side view in partial section showing the handle assembly which activates the second valve means mounted on the flush tank.

FIG. 6 is a detailed view of the connecting bracket which forms part of the mounting means mounted within the mounting sleeve serving to interconnect the housing to the remainder of the flush tank.

Similar reference characters refer to similar parts throughout the several views of the drawings.

DETAILED DESCRIPTION

As shown in FIGS. 1 and 2 the double flush valve assembly generally indicated as 10 is disposed for mounting within a conventional flush tank 12 having water 14 maintained therein. For purposes of explanation water level line 16 is representative of the maximum level on the average of water maintained in the flush tank during its normal use and operation. Water level 18 represented in broken lines is the level or depth of water at which the first valve means 22 is generally located whereas the water level 20 represented in broken lines is the level or depth at which the second valve means 24 is located.

The double flush valve assembly of the present invention comprises a housing generally indicated as 26 which includes a first conduit means 28 and a second conduit means 30 which are disposed in interconnected, fluid communication to one another by interconnecting conduit 32. The first conduit means 28 has a first conduit inlet 34 whereas the second conduit means 30 has a second conduit inlet 35. A first valve means 22 comprises valve elements including a valve 36 secured to the undersurface of a valve flap 37 which itself seats on the first valve seat 34. The valve flap or valve element is pivotally attached by connecting arm 38 to a snorkel or first vent conduit or pipe 40 in the embodiment of FIG. 1. The embodiment of FIG. 2 includes arms 38 attached to second vent pipe 41. In any event this pivotal connection allows movement of the valve element off the outlet of the first conduit means 2. Interconnecting conduit 39 also comprises a part of housing 26 and is disposed in fluid interconnecting relation between second conduit means 30 and the first conduit means 28 and the flush tank outlet. Obviously in regard to FIG. 2 the first valve means and the second valve means are disposed in their closed position. Similarly, a pivotal connecting arm 42 is interconnected to the valve flap 43 at the second valve means wherein a valve bulb or valve element 44 serves to be connected to the underside of the valve flap 43 such that the entire flap and valve element serves to seat on the second conduit inlet 35.

An important structural feature of this invention represents the disposition of both the first valve element and particularly the valve flap and the second valve element and also in particularly the respective valve flap at an angular orientation relative to horizontal. This in turn is to conform to the angular orientation of the valve seat or respective conduit inlet to which the respective valve means are attached. This angular orientation aids the "suction" of the valve flap to the respective conduit inlet and serves to increase the sealing effect of the relative valve flaps to the relative conduit inlets or respective seats when respective first and second valve means 22 and 24 are maintained in their closed position. Preferably this angle of inclination or orientation should be in the range of approximately 5° off horizontal. It should be apparent that other specific angular degrees or orientation can be effected without changing the function or operation of the valve means relative to their sealing effect on their respective valve seats.

The present invention further comprises the interconnection of the first valve means 22 and in particular valve flap 37 to a pull chain 49 which in turn is connected at its opposite end 50 to a lever arm 51. The lever arm 51 is connected to the primary or conventional flush handle 52 in the normal fashion. Operation of the primart flush handle 52 reacts in the conventional manner by manipulation thereof to lift valve flap 37 off of the inlet 34 to the first conduit means 28.

The second valve means is activated by a pull chain 53 being interconnected at one end to the second valve flap 43 as at 54 and having its opposite end as at 55 connected to lever arm 56. The lever arm is activated by an auxilary or secondary flush handle 57 which is spaced apart from the primary or normal flush handle 52. The secondary flush handle 57 is connected to the exterior or upper rim of the flush tank 12, as best shown in FIG. 5, by a connecting bracket generally indicated as 58. More specifically, and as best shown in FIGS. 1 through 5, partition of the auxilary flush handle 57 causes rotation of lever arm 56 which in turn causes rotational movement of lever arm extention 61. A counter weight assembly including weight element 62 attached to one end of extension 61 serves to bring the extension 51 and accordingly, the lever arm 56 back to its normal position as best shown in FIG. 3. The opposite end of extended 61 is connected to the pull chain 53 as at 55 (FIG. 5). The activation of the auxiliary flush handle 57 and the accompanying rotational movement of lever arm 56, through action of pull chain 53 causes (FIG. 2) the removal or displacement at the second valve element or flap 43 from the valve seat 35 which in turn defines the inlet to the second conduit means 33.

More specifically with reference to FIGS. 3, 4 and 5, the auxilary flush handle connecting bracket 58 connects the entire auxilary handle 57 and the attended assembly to the upper rim of the flush tank 12 as best shown in FIGS. 1, 2 and 5. The longitudinal configuration of the lever arm 56 is such as to displace the auxilary handle 57 somewhat below the upper peripheral rim of the flush tank 12 thereby allowing the conventional lid of the flush tank to be placed there over and essentially surround the entire connecting bracket 58 without interfering with the movement of the auxilary flush handle 57.

In order to affixedly attach the auxilary flush handle 57 and its attendant assembly to the flush tank 12, an adjustment means generally indicated as 100 comprises conventional screw-type connector 101 serving to interconnect portions of the connecting bracket 58 as at 102 and 103. Accordingly, by removal and/or adjustment of portion 102, through the provision of elongated slots 104, the portion 102 may be moved relative to the remaining portion of the interconnecting bracket 58 thereby causing the thickness between connecting block portions 105 and 106 to vary so as to accommodate the thickness of the wall of the flush tank 12 as at 107. It is recognized that the thickness of the flush tank 12 is generally consistent. Accordingly, it is further recognized that the adjustment means generally indicated as 100 is not necessary in all applications. The opposite end of the bracket 68 comprises spring gripping arms 74 which have their distal ends as at 75 connected to the opposite end 76 of the sleeve 66. The conventional screw-type connector 72 shows to secure the opposite ends 73 and 74 to one another and is disposed on the interior of sleeve 66 as shown in FIG. 6. Accordingly, the bracket 68 is of the type to be readily secured in the position shown in FIG. 6 by any person having ordinary mechanical skills in utilizing conventional tools such as a screwdriver, of the like. Mere tightening of the conventional connector element 72 in turn allows the entire double flush valve assembly to be secured on the interior of the tank at the outlet of the tank as best shown in FIG. 2.

With reference to FIGS. 2 and 6 the present invention further comprises a mounting means in the form of a substantially elongated hollow sleeve element 66. Interconnection of the housing to the sleeve and more specifically, to the flush tank itself occurs through the provision of a bracket means 68 (FIG. 6) having one of its ends 69 mounted on one end of the sleeve as at 70 and permanently affixed to the housing itself as at 71 (FIG. 2). Additional structure of the present includes a second vent conduit 41 attached directly to the first valve means 22 adjacent as outlet of the first conduit means so as to provide a supplementary or excess air supply to the interior of the conduit means, the first conduit itself and the conduit inlet 37. This provision of excess air eliminates the possibility or substantially reduces the effect of any negative pressure being built up within the conduit means during a flushing operation from the second valve means 24. Accordingly, a "fast flush" is accomplished wherein liquid flows from the flush tank at a faster or greater rate thereby cleaning the toilet bowl more effectively and in turn using much less water to dispose of the waste and clean the toilet bowl. The rapid flow of water from the flush tank serves to remove the waste material from the bowl at a faster pace than would normally be available when utilizing prior art or conventional structure or double flush valve assemblies which are now on the market or the subject matter of prior art patents. Similarly a third vent conduit 110 is interconnected immediately adjacent the second conduit means inlet 35. Connector 111 may be used to secure conduit 110 to the interior of the flush tank 12 (FIG. 2).

Other structures as clearly shown in FIG. 2 is substantially conventional and includes a flush tank inlet 90 secured by conventional connector, washer, etc., means 91 fill conduit 92 secured to the inlet 90 and attached at its opposite end to a control valve mechanism 93 which is activated by a float 94 attached to the distal end of the lever arm 95. As is done in conventional toilet facilities the raising of the liquid level causes the raising of the float 94 which in turn causes the shut-off of valve 93 and the stopping of liquid or fluid flow into the interior of the flush tank 12. Vent conduit 40 also serves as an overflow or snorkel pipe and has its open end 96 disposed in the air space normally above the normal liquid or water level 16 maintained within the flush tank.

In operation the normal level of water 16 is maintained within the flush tank in the conventional manner. When a light waste or waste of little quantity is deposited in the toilet bowl it may be removed therefrom and the toilet bowl may be cleaned through the activation of the supplementary flush handle 57. This will of course unseat the second valve means and more particularly the second valve element from the inlet to the second conduit 35 thereby causing the water or liquid within the flush tank to empty into the toilet bowl and be reduced to a level equivalent to that demonstrated by level 20.

When a regular flush is desired due to the deposit of heavier waste or a greater quantity of waste within the toilet bowl the primary or conventional flush handle 52 is activated causing unseating of the valve seat 34 of the first conduit means 28. This will remove the water in the flush tank down to the level 18 and deposit the entire amount within the toilet bowl for cleaning and disposition of the waste material therein.

It should be noted that the savings in water, in the conventional dimension in the conventional size flush tank when utilizing the second valve means 24 rather than the first valve means 22 results in the savings of approximately one and a half gallons per flush. Accordingly, it can be seen that great quantities of water can be readily saved through the utilization of the present invention over that of conventional methods and structures.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween, Now that the invention has been described, what is claimed is:

1. A flush valve assembly of the type commonly designed to release predetermined quantities of water from a flush tank to a toilet bowl, said flush valve assembly comprising: housing means grounded on the interior of the flush tank in fluid communication between the interior of the flush tank and the tank outlet, said housing means comprising conduit means dimensioned and configured to direct water from the interior of the tank to the tank outlet, said conduit means comprising at least a first and second conduit inlet and at least a single conduit outlet, said conduit outlet interconnected to the tank outlet, said first and second conduit inlets disposed at different depths within the interior of the flush tank, a first and second valve means connected in fluid flow regulating position to said first and second conduit inlets respectively, mounting means disposed within the tank inlet and connected to said housing means so as to position the conduit means in liquid channelling relation between the tank interior and the tank outlet; the primary flush handle mounted on the flush tank and disposed at least partially on the exterior thereof and interconnected to said first valve means for activation thereof, and auxiliary flush handle mounted on the flush tank and at least partially on the exterior thereof and interconnected to said the second valve means for activation thereof, the primary flush handle and said auxiliary flush handle disposed in spaced apart, separated relation to one another on independent portions of the flush tank, whereby different quantities of water are released from the flush tank by activation of different ones of the primary and said auxiliary flush handle.

2. A flush valve assembly as in claim 1 wherein said first valve means is disposed within the flush tank at a greater depth than said second valve means, said first valve assembly including the first valve element movably connected for engagement with a valve seat, said valve seat at least partially defined by said first conduit inlet, said first valve element and conduit inlet disposed at an angular relation to horizontal when in closed position.

3. A flush valve assembly as in claim 2 wherein said second valve means includes a second valve element movably connected with a second valve seat, said second valve seat at least partially defined by second conduit inlet, said second valve element and said second conduit inlet are disposed at an angular relation to horizontal when in a closed position.

4. A flush valve assembly as in claim 1 further comprising vent means connecting to said housing adjacent to the tank outlet and in fluid communication therewith, said vent means disposed to direct air into said conduit means and tank outlet, whereby fluid flow is increased due at least in part to absence of negative pressure in said conduit means, when either said first or second valve means is disposed in an open position.

5. A flush valve assembly as in claim 4 wherein said vent means comprises a first vent conduit mounted on the interior of the flush tank and interconnected between said housing and air space above the normal level of liquid within the flush tank.

6. A flush valve assembly as in claim 5 wherein said vent means further comprises a second vent conduit connected to said housing adjacent first valve means and disposed and configured to vent air into said housing means at the outlet of the flush tank.

7. A flush valve assembly as in claim 6 wherein said second vent conduit is disposed in air channeling relation to said first conduit means and the outlet to the flush tank, said second vent conduit disposed in angularly oriented relation to horizontal and correspondingly angularly oriented at the same disposition as said first valve means.

8. A flush valve assembly as in claim 1 wherein said mounting means comprises a sleeve element disposed as in the flush tank outlet and disposed in interconnecting relation between said housing means and the exterior of the flush tank, bracket means interconnected between said sleeve and said housing conduit means and disposed to secure said housing means to the flush tank and establish fluid communication between said conduit means and the flush tank outlet.

9. A flush valve assembly as in claim 8 wherein said bracket means is mounted at least in part on the interior of said sleeve and connected at substantially opposite ends thereof to said housing in said sleeve, wherein said housing means is interconnected in fluid communication with the flush tank outlet.

10. The flush valve assembly as in claim 9 wherein said bracket is secured at one end to said housing means and including the opposite end thereof secured to said sleeve, connector means disposed in movably interconnector relation to opposite ends of said bracket and configured for relative movement for predetermined relative positioning of said opposite ends of said bracket relative to one another.

* * * * *